US005916119A

United States Patent [19]

Lovas et al.

[11] Patent Number: 5,916,119

[45] Date of Patent: Jun. 29, 1999

[54] DEVICE FOR THE CONTROL OF AN AIR STREAM IN AN OPEN-END SPINNING DEVICE

[75] Inventors: Kurt Lovas, Böhmfeld; Edmund Schuller, Ingolstadt, both of Germany

[73] Assignee: Rieter Ingolstadt Spinnereimaschinenbau AG, Ingolstadt, Germany

[21] Appl. No.: 08/899,132

[22] Filed: Jul. 23, 1997

[30] Foreign Application Priority Data

Aug. 2, 1996 [DE] Germany ..... 196 31 234

[51] Int. Cl.[6] ..... D01H 11/00

[52] U.S. Cl. ..... 57/301; 57/263; 57/302; 57/304; 57/406; 57/407

[58] Field of Search ..... 57/301, 302, 304, 57/263, 406, 407

[56] References Cited

U.S. PATENT DOCUMENTS

| | | | |
|---|---|---|---|
| 4,028,136 | 6/1977 | Kamp . | |
| 4,038,812 | 8/1977 | Stahlecker . | |
| 4,058,963 | 11/1977 | Stahlecker | 57/302 |
| 4,069,654 | 1/1978 | Roehrich . | |
| 4,069,655 | 1/1978 | Stahlecker et al. | 57/407 |
| 4,089,155 | 5/1978 | Stahlecker | 57/263 |
| 4,485,616 | 12/1984 | Morita et al. | 57/263 |
| 4,676,059 | 6/1987 | Artzt et al. | 57/263 |
| 4,893,462 | 1/1990 | Braun et al. . | |
| 5,367,867 | 11/1994 | Lovas et al. . | |
| 5,640,838 | 6/1997 | Billner et al. | 57/263 |
| 5,694,756 | 12/1997 | Lindner et al. | 57/263 |

OTHER PUBLICATIONS

German Search Report, Oct. 11, 1996.
EPO Search Report Dated Dec. 13, 1997.

*Primary Examiner*—William Stryjewski
*Attorney, Agent, or Firm*—Dority & Manning

[57] ABSTRACT

The present invention relates to a device for the control of an air stream in an open-end spinning device (6). The open-end spinning device (6) is equipped with an air channel (8) opening into the second housing compartment (600) of the open-end spinning device (6), which is connected via a valve (82) to a connection opening (83). An air channel (95) with a presentation end (950) located on a traveling service carriage (9) can be presented to this connection opening (83). This presentation end (950) is connected by means of a movable intermediate segment (951) to the air channel (95) and is capable of movement relative to same so that when the connection opening (83) is swiveled, it follows this movement without changing its position relative to the connection opening (83).

18 Claims, 4 Drawing Sheets

DEVICE FOR THE CONTROL OF AN AIR STREAM IN AN OPEN-END SPINNING DEVICE

BACKGROUND OF THE INVENTION

The present invention relates to a device for the control of an air stream in an open-end spinning device.

Such a device is known from DE-OS 24 58 538. In order to remove waste from the different areas of the spinning device without requiring the intervention of an operator, the service carriage is brought to the waiting spinning station and at least one suction air conveying channel, and possibly also a compressed-air conveying channel, is presented to one or several matching connection openings provided in the cover of the open-end spinning device, whereupon the air stream needed to remove the dirt is brought to bear. It has been shown however that in certain cleaning operations, problems which can only be corrected manually may occur here, for example when the fiber ring remaining in the spinning rotor during the cleaning of the fiber collection surface slides on the cover projection or extension extending into the interior of the spinning rotor and is unable to leave, so that subsequent piecing is impossible.

OBJECTS AND SUMMARY OF THE INVENTION

It is therefore a principal object of the present invention to create a device ensuring pneumatic supply of the open-end spinning device without provoking problems which can only be eliminated by manual intervention. Additional objects and advantages of the invention will be set forth in part in the following description, or may be obvious from the description, or may be learned through practice of the invention.

The objects are attained according to the characteristics of the present invention. In this manner the air stream controlled from the service carriage can continue to flow, whether or not the connection opening is in its closing position or in its defined swiveled position. This defined swiveling movement makes it possible, for example, to optimize the rotor cleaning process in that a fiber ring can be reliably removed thanks to the increased distance between the open rotor edge and the rotor cover and also facilitates the control of the rotor run-up during the spinning process.

The invention makes it possible for the compressed-air stream to be active in the spinning rotor not only during the cleaning of the fiber collection surface of the spinning rotor, when the connection opening and thereby also the rotor cover which is slaved by the connection opening are in closing position. Instead, the supply of compressed air into the spinning rotor is maintained undiminished, even during the defined swiveling of the connection opening and of the rotor cover. This is because the swiveling of the connection opening moves the rotor cover so far away from the open rotor side that an enlarged air gap is produced at that location which facilitates removal of the fiber ring by means of the air stream which leaves the rotor interior at this point to such an extent that it can even remove a fiber ring that may have remained suspended on the cover projection.

The invention can not only be used to advantage for rotor cleaning however. It has been shown that the device according to the invention is also advantageous in a process in which the fibers are conveyed at first via the input opening of a fiber feeding channel conveying the fibers to the fiber collection surface of the spinning rotor and to a suction system until they are again fed to the fiber collection surface in timely coordination with a yarn end being fed back for the purpose of piecing.

So that no separate drives are required in order to bring the air channels which have to be presented to the open-end spinning device for maintenance or for piecing purposes to their corresponding connection openings if several air channels are installed on the service carriage, an alternative embodiment of the device according to the invention is provided whereby the presented ends are arranged advantageously and the same drives and/or designs can be selected for the presented ends and their matching intermediate segments.

An embodiment of the device has the advantage that even when tolerance fluctuations are great between the position of the presented end and the connection opening, reliable introduction of the presented end into the receiving opening is nevertheless ensured easily.

In principle, it is possible to impart such movement at the service carriage level to the presented end that it remains in contact with its appertaining connection opening when the connection opening is swiveled. An especially favorable design solution is provided by the invention due to the fact that the presented end is not driven actively from the service carriage, but is slaved passively by the swiveling connection opening or its holder or by the cover. Various designs are possible for the slaving device on the cover.

With an embodiment of the invention, control devices for the slaving device are not needed yet simple and secure coupling and uncoupling can be ensured.

In an alternative embodiment of the invention, air losses are avoided.

An embodiment of the invention is designed to avoid having to adjust the presentation depth of the presented ends with extreme precision while nevertheless ensuring air-tight coupling between connection opening and presented end.

Different designs are possible according to the invention for the intermediate segment in order to obtain the desired mobility, e.g. in the form of an air-carrying pipe system.

The valve can be controlled from the service carriage in different manners through an embodiment of the device of the invention.

The construction of the invention is simple and is multi-faceted in its application, since a reliable pneumatic connection can be maintained during the entire maintenance period, regardless of whether the connection opening of the open-end spinning device then maintains its closed position which it assumes during normal spinning operation, or whether it is brought into a position in which the rotor cover which is interlockingly connected to it uncovers the open rotor side and thereby facilitates the removal of a fiber ring thanks to an enlarged collection air gap between the open rotor edge and the rotor cover or in which the spinning rotor is separated from its drive and is braked by means of a rod system connected to its cover. At the same time, a fiber stream, although it has been released, is prevented from entering the spinning rotor and is removed instead in a suction system.

Further details of the invention are explained in greater detail below through examples of embodiments shown in drawings.

DETAILED DESCRIPTION OF THE PREFERRED EMBODIMENTS

Figure 1:
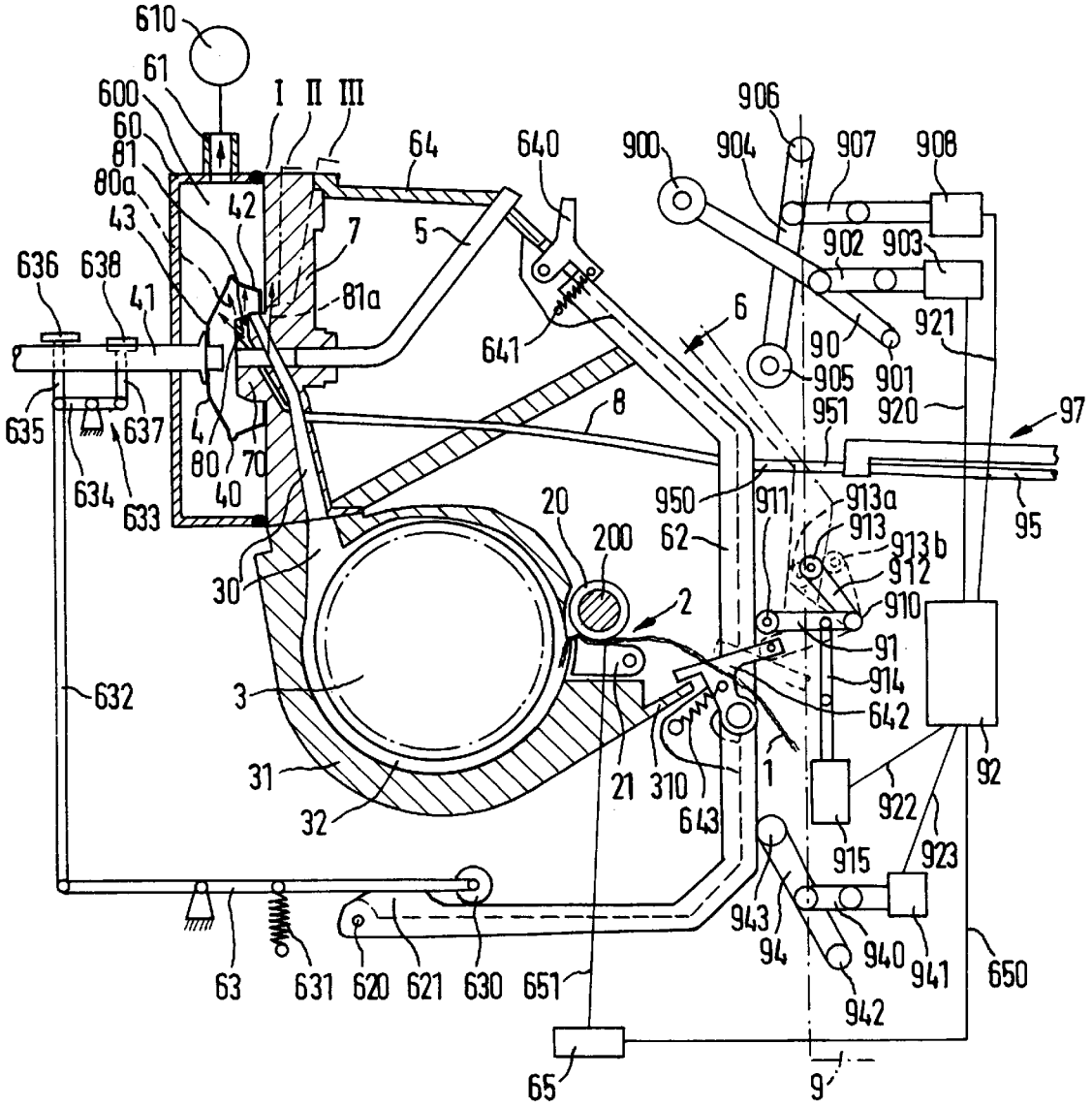
FIG. 1 shows a cross-section of an open-end spinning machine according to the invention which can be supplied with overpressure from a service carriage.

Reference will now be made in detail to the presently preferred embodiments of the invention, one or more examples of which are illustrated in the drawings. Each example is provided by way of explanation of the invention, and not meant as a limitation of the invention.

FIG. 1 shows an open-end spinning device 6 schematically, and those elements which are not necessary to the understanding of the invention have been left out for the sake of clarity. The open-end spinning device 6 is a component of an open-end spinning machine with a plurality of identical work or spinning stations next to each other, each with an open-end spinning device 6.

To feed a fiber sliver 1 to be spun to a opener roller 3, a feeding device 2 is provided which, in the embodiment shown, is supported on a continuous drive shaft 200 and is equipped with a delivery roller 20 controlled by an individual coupling (not shown) and which interacts with a feed trough 21. The feed latter is supported in a known, swiveling manner by a housing 31 which contains the above-mentioned opener roller 3 in a first housing compartment 32. From here, the fiber sliver 1, opened into individual fibers, goes through a fiber feeding channel 30 into a spinning rotor 4 where the fibers are deposited in a fiber collection groove 40 in the form of a fiber ring. The fiber ring is continuously spun into the end of a yarn which is not shown, and which is wound up by a yarn draw-off pipe 5 in a known manner to be then wound up.

The spinning rotor 4 located in a second housing compartment 600 in the housing 60 is mounted in the usual manner on a shaft 41 which extends through the bottom of the housing 60 which is connected via a suction air connection piece 61 to a source of suction air 610. The housing compartment 600 is covered by a rotor cover 7 which contains at least part of the fiber feeding channel 30 and supports the yarn draw-off pipe 5.

The rotor cover 7 protrudes with a cover extension 70 into the inside of the spinning rotor 4. The output opening of the fiber feeding channel 30 and the input opening of the yarn draw-off pipe 5 as well as in the embodiment shown two or more blow channels 80 and 81 which are supplied with compressed air (see compressed-air streams 80*a* and 81*a*) via a common air conveying channel 8, are installed in this cover extension 70. The air conveying channel 8 is connected to a controllable valve 82 (see FIGS. 2 and 3).

The elements of the open-end spinning device 6 described above are covered by a cover 64 which is mounted on an axis 620 so as to be able to swivel. The cover 64 supports the above-mentioned valve 82 which is followed by connection opening 83.

Figure 2:
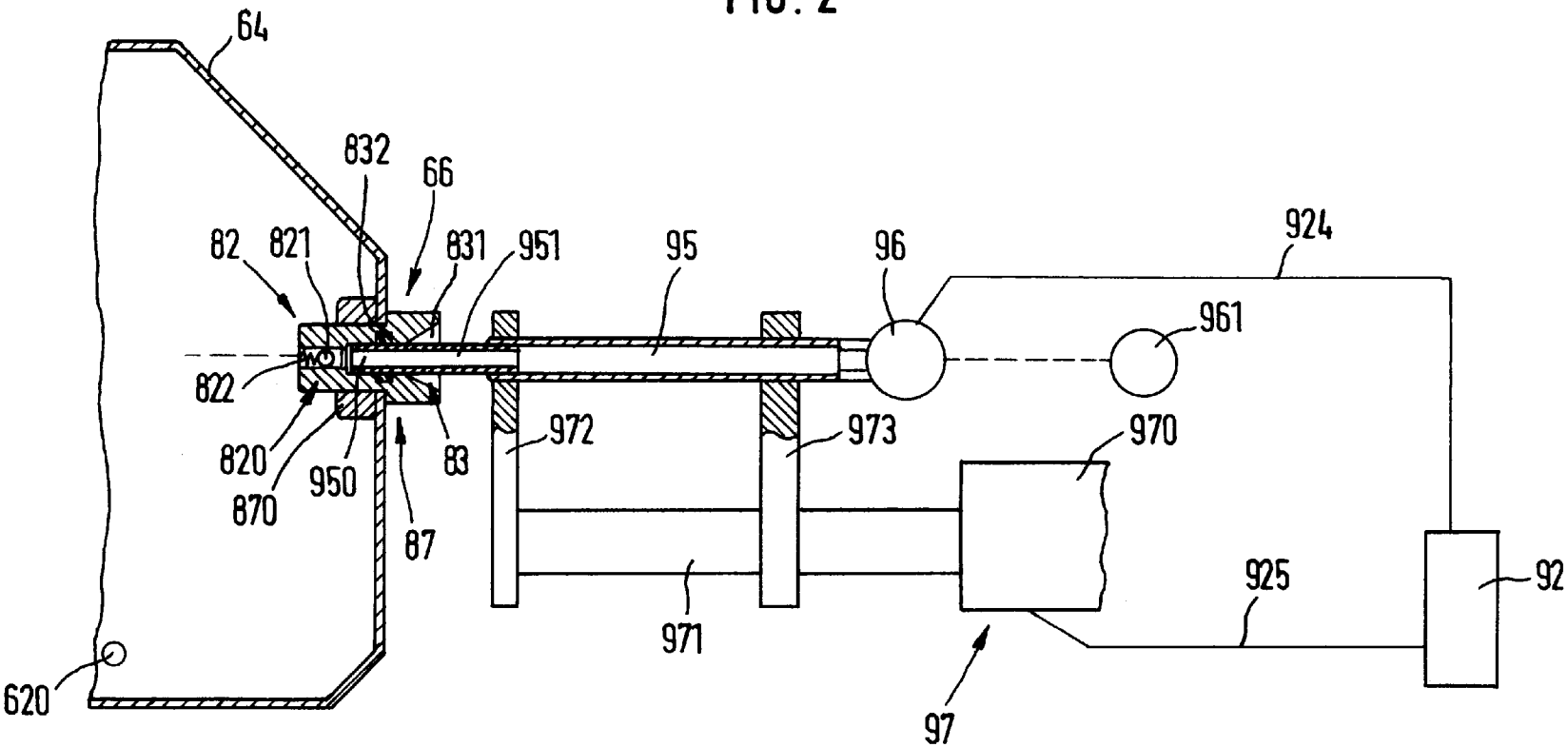
FIGS. 2 and 3 show a schematic cross-section of a detail of the device shown in FIG. 1, with the cover in its basic position or in a position swiveled around a fixed angle.
Figure 3:
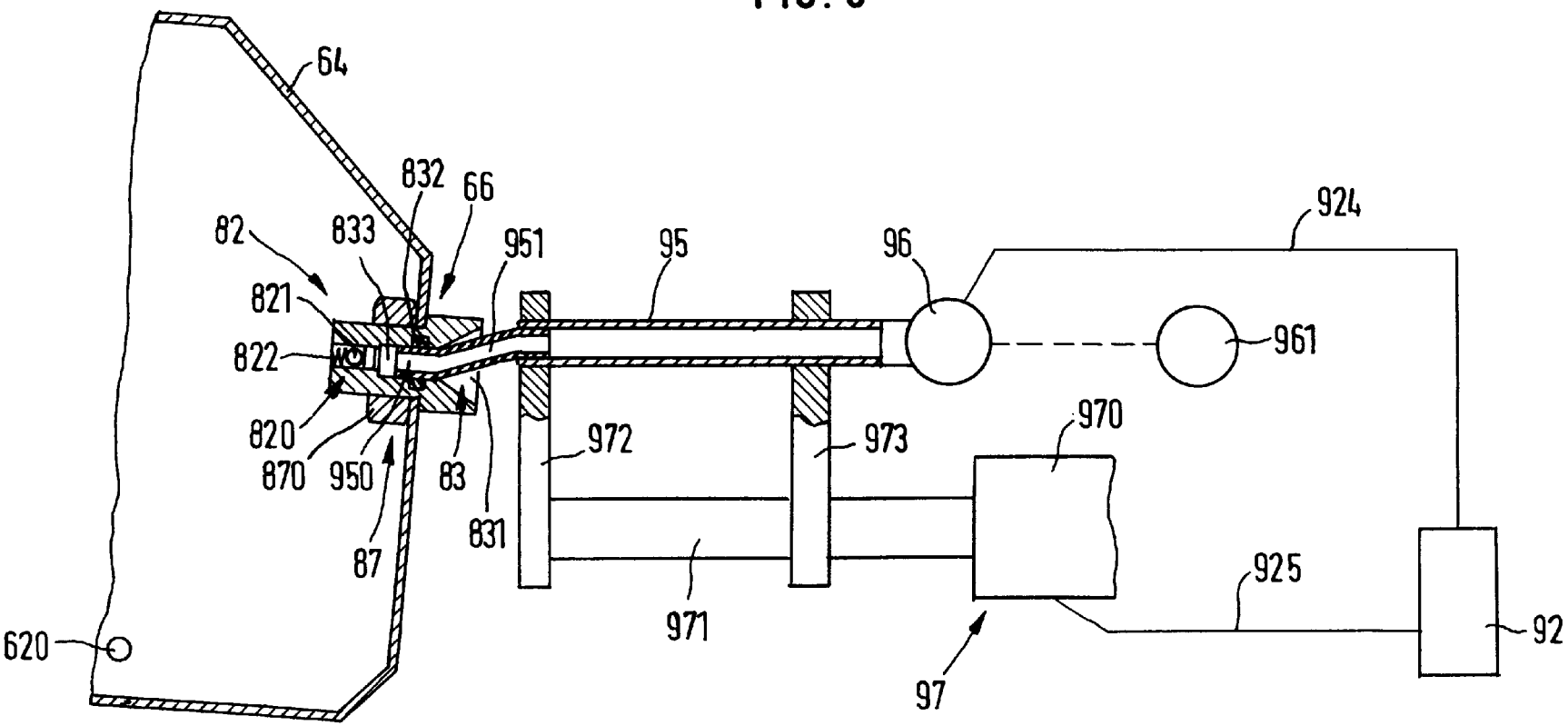

In the embodiment shown in FIGS. 2 and 3, the valve 82 is provided with a chamber 820 after the connection opening 83 on its side towards the air channel 8, said chamber 820 containing a ball 821 which is held pressed against a ring-shaped seat by a compression spring 822 supported in an appropriate manner for as long as it is not subjected to an over-pressure prevailing in the connection opening 83 which exceeds the force of the compression spring 822.

The cover 64 furthermore supports the previously mentioned rotor cover 7 which is thereby connected to the cover 64, so that when the cover 64 is swiveled, the rotor cover 7 is also removed from the open side of the spinning rotor 4 and of the housing 60.

A control lever 62 for the control of the rotor drive is installed in a slit of the cover 64. The control lever 62 is mounted together with the cover 64 on a horizontal shaft 620—and is provided with a control cam 621 in proximity of this shaft 620. A roller 630 which is located at one end of a two-arm lever 63 is supported on the control lever 62 in the area of the control cam. The lever 63 is subjected to the force of a draw spring 631 in such manner that the roll 630 is always pressed against the control lever 62.

On the end away from roller 630, the lever 63 is connected via a control rod 632 to a rod system 633 which is shown here in a much simplified form. The rod system 633 in the embodiment shown is provided with a weighing lever 634 one end of which is connected via a rod 635 to a brake 636 of the spinning rotor 4 and the other end of which is connected via a rod 637 to a mechanism which is not shown and which serves to lift a drive belt 638 from the shaft 41 of the spinning rotor 4 or to re-apply the drive belt 638 on shaft 41.

In addition to the above-mentioned elements, the cover 64 supports an actuating lever 640 which holds the control lever 62 by means of a draw spring 641 in the position shown, in opposition to the action of the draw spring 631 which acts upon lever 63 upon the control lever 62.

The cover 64 supports yet another actuating lever 642 which is subjected to the force of a draw spring and is thereby held in the shown locking position in which the actuating lever 642 reaches behind a nose 310 into housing 31. The actuating lever 642 has the task of making it possible to lift the rotor cover 7 from housing 60 by swiveling the cover 64.

On a service carriage 9 traveling alongside the open-end spinning machine, an actuating arm 90 with a roller 900 on its free end for the actuation of the actuating lever 640 for the release of the control lever 62 in its basic position, is mounted on a shaft 901. A reset lever 904 with a roller 905 on its free end to return the control lever 62 in its starting position, flush with the cover 64, is installed on shaft 906. A swiveling device of the cover 64 with an actuating arm 91 is mounted on a shaft 910 and is provided at its free end with a roller 911 interlockingly connected to a stop arm 912 mounted on the same shaft 910 and connected at its free end with a stop roller 913. The swiveling device furthermore comprises a reset lever 94 pivoting around an axis 942 with a roller 943 at its free end to return the cover 64 into its closed position.

The actuating arm 90, the reset lever 904, the actuating arm 91 and the return lever 94 are each connected via a coupling element 902, 907, 914 or 940 to a swivel drive 903, 908, 915 or 941. The swivel drives 903, 908, 915 and 941 on the other hand are each connected via a control circuit 920, 921 and 941 to a common control system 92 of the service carriage 9 which is in turn connected via a control circuit to a control device 65 on the machine. The latter is connected, among other things, also via a control circuit 651 to the previously mentioned and not shown coupling of the delivery roller 20.

The service carriage 9 is provided with an air channel 95 with a controllable valve 96 which is connected to an over-pressure source 961, or can be connected to one depending on the position of the service carriage 9, and is also connected via a control circuit 924 to the control device 92. The air channel 95 terminates in a presentation end 950 which can be presented to the earlier-mentioned connection opening 83. The air channel 95 does not merge directly into its presentation end 950 for reasons to be described in further detail below, but is connected to it via a movable intermediate segment 951.

The air channel 95 is supported in the service carriage 9 by a drive device 97 in such a manner as to be capable of axial displacement. The drive device 97 according to FIGS. 2 and 3 is provided with a piston 971 which can be driven by a pneumatic or hydraulic cylinder 970 and is connected via a control circuit 925 to the control device 92. The piston 971 carries the above-mentioned air channel 95 by means of one or several holders 972 and 973 so that it presents the presentation end 950 to the connection opening 83 or removes it from same again in function of an actuation or a release of the cylinder 970.

The functioning of this device is described below with the help of FIGS. 1 to 3 in connection with rotor cleaning, which is followed by the usual piecing operation.

In spite of all prior treatment of the fiber material to be spun, individual shell particles and other dirt elements enter the spinning rotor 4, in particular the fiber collection surface 40, and therefore yarn breakage occurs from time to time and must be repaired. When their cause is removed, shell particles etc., as well as the fiber residue produced as a result of yarn breakage, must be removed from the spinning rotor 4. For this reason the spinning rotor 4 is cleaned in the usual manner at regular time intervals or whenever a yarn breakage occurs. In that case, the control device 92 of the service carriage 9 causes via control circuit 925 the cylinder 970 to be subjected to compressed air or to a hydraulic medium so that the piston 971 moves the presentation end 950 of the air channel 95 by means of the holders 972 and 973 in the direction of the cover 654 and thus presents it to the connection opening in such a manner that air can neither escape nor enter at this point, i.e. a sealing presentation of the presentation end 950 to the connection opening 83 takes place.

Following this, controlled by the control device 92, the valve 96 located in the air channel 95 is opened via the control circuit 924, so that compressed air goes from the source of over pressure 961 into the air channel 95 and from there via the presentation end 950 and the connection opening 83 into the air channel 8. The valve 82 is then opened by means of the appearing over pressure, so that compressed air enters the blowing channels 80 and 81.

At the same time, the swiveling drive 903 is actuated from the control device 92 via the control circuit 921 in order to press the actuating arm 90 against the actuating lever 640, thus releasing the control lover 62 which is now pushed out of the previously mentioned slit of the cover 64 in the direction of the service carriage 9 under the effect of the draw spring 631. In this process, the drive belt 638 is lifted from the shaft 41 of the spinning rotor 4 via lever 83, control rod 632 and rod system 633, and the brake 636 is brought to bear against the shaft 41. The compressed air which has entered the interior of the spinning rotor 4 through the two blowing channels 80 and 81 during this braking operation of the spinning rotor 4 sweeps at the same time through the entire circumference of the spinning rotor 4 in the form of the two compressed-air streams 80*a* and 81*a*.

During this first phase of rotor cleaning, the cover 64 and thereby also the movably interlocking rotor cover 7 are still in their closed Position I in FIG. 1.

This first cleaning phase is then followed by a second cleaning phase in which the rotor cover 7 is lifted from the housing 60 and thereby from the open edge 42 of the spinning rotor 4 and is brought into a defined position II. For this, the swivel drive 915 is actuated from the control device 92 and presses the actuating arm 91 against the actuating lever 642 so that the actuating lever 642 is unhooked from the nose 310 of housing 31, whereupon the cover 64, due to the placement of its axis 620 and gravity, falls in the direction of the service carriage 9 until the cover 64 comes to bear against the stopping roller 913 which now assumes position 913*a* (see outline in broken lines).

In this position II of the cover 64, the compressed-air stream 80*a* is oriented so that it lifts the fiber ring out of the fiber collection groove 40 and presses it in the direction of the open edge 42 of the spinning rotor. The other compressed-air stream 81*a* blows at the same time over the open edge 42 of the spinning rotor 4 and pulls the fiber ring into the effective range of the suction air stream which leaves the housing 60 through the suction air connection piece 61.

To ensure that the presentation end 950 does not alter its relative sealing position to the cover 64 and in particular to the connection opening 83 during the swiveling movement of said cover 64, the presentation end 950, which is in sealing contact with the cover 64 and the connection opening 83 in its presenting position, must adapt to each movement of the cover 64, i.e. it must follow it. This can be accomplished in that a positive drive is assigned to the presentation end 950 on the service carriage 9, whereby this positive drive imparts such movement to the air channel 95 in its presenting position at the connection opening 83 while the position of the air channel 95 remains unchanged, that it assumes at every instant a position in which the sealing connection between presentation end 950 and air channel 8 is assured.

Since such a positive drive is rather complicated, a passive drive of the presentation end 950 in the form of a slaving device 66 installed on the cover 64 is provided in the embodiment shown in FIGS. 2 and 3. It is constituted by the connection opening 83 into which the presentation end 950 of the air channel 95 is inserted with a cylindrical segment as it is presented to the connection opening 83. Thereby, the presentation end 950 cannot leave its relative position with respect to this connection opening 83, which is made in the form of a slaving device 66 when the cover 64 swivels. The presentation end 950 can be moved relative to the air channel 95 in such a manner that it is able to follow the swiveling motions of the cover 64, whereby the intermediate segment 951, which is formed by a hose segment in the embodiment shown, absorbs every swiveling motion of the presentation end 950 thanks to its flexible or movable design.

Following the rotor cleaning operation described above, a piecing process takes place in a known manner, and for this the cover 64 is brought back into its starting position by means of the above-mentioned swiveling device, so that the spinning process can be continued.

In some cases it may happen that the fiber ring cannot be removed immediately with the first attempt from the spinning rotor 4. For this reason, it is possible to provide for a multiple opening and closing of the rotor cover 7 by means of the control device 92 of the service carriage 9 and thereby for a multiple alternation between the two cleaning phases.

With certain materials it may be advantageous for the rotor cover 7 to be brought into a position III (see dot-dash representation in FIG. 1) for the removal of the fiber ring, in which the cover extension 70 is at a greater distance from the spinning rotor 4 than in position II and is swiveled completely out of the interior of the spinning rotor 4 if necessary. For this purpose the contact roller 913 is brought into position 913*b*.

The spinning rotor 4 must be cleaned for as long as it is in a braked state so that the loosened fibers may not be prevented by the centrifugal force in the spinning rotor from being removed by the suction air stream which leaves the spinning rotor 4 through the suction air connection piece 61. In the interest of simple design and control of such a device for the braking and renewed release of the spinning rotor 4, this control is effected by means of the above-described control lever 62 which can be swiveled either together with the cover 64 or independently thereof, as needed. If the control lever 62 is in its starting position and thereby movably connected to the cover 64, the rotor drive can also be controlled by the cover 64 itself. Thereby it is possible, by swiveling the cover 64 when the presentation end 950 is presented, to switch on fiber feed via the coupling of the delivery roller 200 already in the course of rotor cleaning, whereby the fibers are removed again from the spinning rotor 4 which is stopped at this time. The fiber feed is then switched off in the known manner, while rotor cleaning continues and the rotor cover 7 is already back in position I or still in position II or even III. Following the switching off of fiber feeding and before actual piecing, in particular up to the moment of switching on the fiber feed which must then be effected again, a defined period of time is allowed to pass, so that a defined fiber tuft is available for piecing.

The object of the invention can be modified in many ways without leaving the framework of the present invention by replacing individual characteristics by equivalents or in other combinations of characteristics. Thus, for example, the location of the source of compressed air 961 is unimportant for the objects described. It may be located on the service carriage 9 itself or the service carriage 9 may be connected continuously or intermittently with an external source of over-pressure 961 in such manner that the supply of compressed air is ensured at all times when the service carriage 9 is located at a spinning station in a servicing position.

The special design of the open-end spinning device 6 is also not of decisive importance for the objects described above. Thus, it is not important whether the first housing compartment 32 which contains the opener roller 31 is located in a first housing 31 and the second housing compartment 600 which contains the spinning rotor 4 is located in a second housing 60 or whether a common housing (not shown) with two separate housing compartments 32 and 600 is provided for the opener roller 3 as well as for the spinning rotor 4.

The design of the rotor cleaning device, i.e. the orientation and number of blowing channels and the air controls therefore (intensity, continuous or intermittent) are of no importance for the present invention.

It is of course possible to clean also other at-risk locations of the open-end spinning device 6 at the same time with the cleaning of the spinning rotor 4. Such at-risk locations are e.g. the outlet of the yarn draw-off pipe 5 and also the location of the first housing compartment 32 where the forward end of the fiber sliver 1 is presented to the opener roller to be opened.

Furthermore, the connection opening 83, as well as the slaving device 66 constituted by the connection opening 83, may also be modified. Thus, in the embodiment shown in FIGS. 2 and 3, the connection opening 83 has a cylindrical receiving segment 833 in which the presentation end 950 can be introduced with a cylindrical longitudinal segment. In order to avoid excessive tensions in the intermediate segment 951, provisions are made according to FIGS. 2 and 3 for the presentation end 950 to be still capable of a certain amount of axial movement relative to the connection opening 83 within said connection opening 83. For this purpose, the cylindrical receiving segment 833 is of such length that the presentation end 950 remains within the receiving segment 833 of the connection opening 83 as the cover 64 swivels.

In the embodiment shown in FIGS. 2 and 3, the connection opening 83 is furthermore provided with a centering segment 831 which widens in the direction of the service carriage 9 in order to increase presentation security when presenting the presentation end 950 to the connection opening 83. It is furthermore possible for the presentation end 950 to become accordingly narrower in the area of its outer contour in the direction of the connection opening 83 (not shown).

In the embodiment shown here, the previously mentioned cylindrical receiving segment 833 follows the centering segment 831. If only a conically tapering centering segment 831 without following cylindrical receiving segment 833 is provided, the annular seal 832 can be installed in this centering segment 831 or in the correspondingly tapering outer contour of the presentation end 950.

According to FIGS. 2 and 3, the connection opening 83 and the valve are located in an insert 87 82 (made e.g. of hard synthetic material) which is attached in a corresponding recess in the cover 64, e.g. by means of a screw connection (see nut 870).

Figure 4:
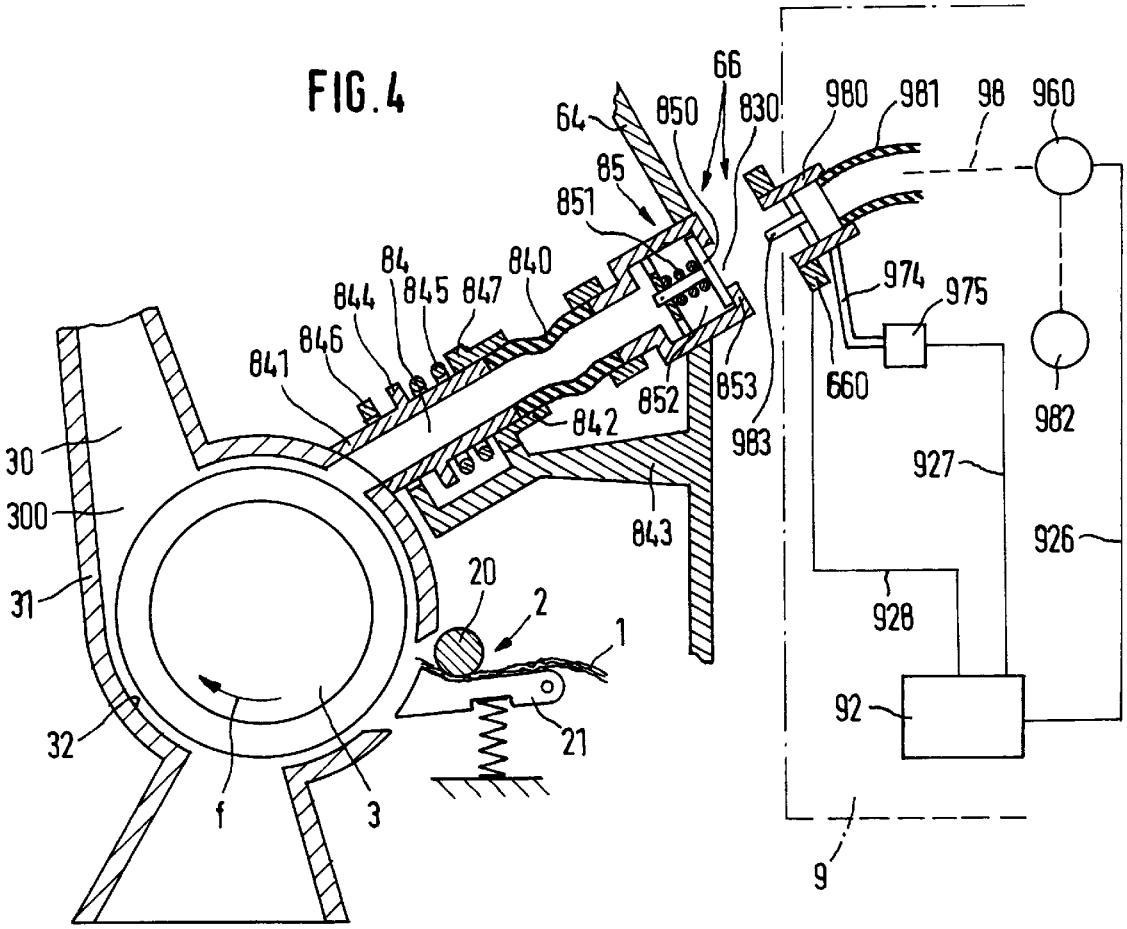
FIG. 4 shows a detail of a modified device in cross-section, with a device for the deflection of the fiber steam.

An additional variation of the invention is shown in FIG. 4. In this embodiment the control lever 62 shown in FIG. 1 can be omitted and the cover 64 itself can be equipped with the switching cam 621 which is scanned by the roller 630.

Between the input opening 300 of the fiber feeding channel 30 and the delivery device 2, i.e. outside the area in which the fibers are conveyed to the spinning rotor 4, the housing 31, as seen in the direction of fiber movement indicated by an arrow f, is connected to an air conveying channel 84 letting out in the circumferential wall of housing 31. This air conveying channel 84 is connected via a movable intermediate segment 840 which consists of a hose segment in the embodiment shown, with intercalation of a valve 85, to a connection opening 830 to which the presentation end 980 of an air channel 98 can be presented. The presentation end 980 is connected to the air channel 98 via a movable intermediate segment 981. The air channel 98 is connected via a valve 960, which is connected via a control circuit 926 to the control device 92, to a source of negative pressure 982 or can be connected to same.

The air conveying channel 84 is constituted by a bushing 841 which is mounted in a guiding sleeve 842 and in a slaving ring 846, these being connected by means of a holder 843 to the cover 64, in such manner as to be capable of axial displacement. The bushing 841 is provided with a stop ring 844 on which a compression spring 845 bears, its other end bearing upon a collar 847 of the guiding sleeve 842, so that the bushing 841 is pressed against housing 31 when the cover 64 is in position I (see FIG. 1). If the cover 64 is swiveled into position II or II (if provided), the compression spring 845 ensures that the bushing 841 remains pressed against the housing 31 so that a sealing connection between the housing compartment 32 and the air conveying channel 84 is maintained. The distance difference between the connection opening 830 and the housing 31 is compensated for by the movable intermediate segment 840.

If the cover 64 is however swiveled away from the open-end spinning device 6 and further than into position II or, if applicable, position III, the stop ring 844 comes to bear against the slaving ring 846, so that the bushing 841 together with the air conveying channel 84 is lifted from housing 31 and follows the swiveling motion of the cover 64.

The presentation end 980 is connected by means of a holder 974 to a suitable drive 975 which in turn is connected via a control circuit 927 for control to the control device 92.

During the preparation for piecing following an interruption of the spinning process, the presentation end 980 is presented in this embodiment also in a sealing manner to the connection opening 830 in the swiveling cover 64. Since the spinning rotor 4 must first be braked during piecing so that unwanted fibers may not collect in its fiber collection groove 40, the cover 64 is first brought into a defined opening position II of the rotor cover in which the switching cam 621 of the cover 64 causes the drive belt 638 to be lifted from the shaft 41 of the spinning rotor while the brake 636 is pressed against the shaft 41. By actuating the valve 960 (actuated by the control device 92, the negative pressure of the source of negative pressure 982 is now brought into action in housing 31, since valve 85 is also opened in the previously described manner simultaneously with the release of valve 960. It is obvious that with an air-controlled valve 85, this valve must be inverted laterally as compared with valve 82 which has been described in connection with FIGS. 2 and 3.

During the piecing preparation, e.g. following the return of a yarn end into a readiness position inside the yarn draw-off pipe 5, the negative spinning pressure which is normally present in the suction air connection piece 610 is brought to bear in a known manner. The feeding device 2 is now switched on again. The fiber stream which resumes its movement due to the switching on of the feeding device 2 is removed in this manner via opening 300 of the fiber feeding channel 30 and the air conveying channel 84 by means of the source of negative pressure 982.

In synchronization with each other, the return of the cover 64 into its starting position I of the rotor cover 7 the brake 636 is lifted from shaft 41 of the spinning rotor 4 and the drive belt 638 is again brought to bear against the shaft, so that the spinning rotor runs up once more to its spinning speed. The resulting closing of the valve 960 switches off the negative pressure effect in the air conveying channel 84 and at the same time the negative spinning pressure is again brought into action in a suitable manner so that the fibers are conveyed to the spinning rotor 4 to be pieced, and the yarn end is fed back by means not shown into the fiber collection groove 40 where the newly added fibers are incorporated and are then drawn off once more.

In this embodiment too, the movable intermediate segments 840 and 981 enable the cover 64 to assume different positions in order to carry out its technological tasks, without having to compromise with respect to the tightness of the presentation point of the presentation end 980.

Figure 5:
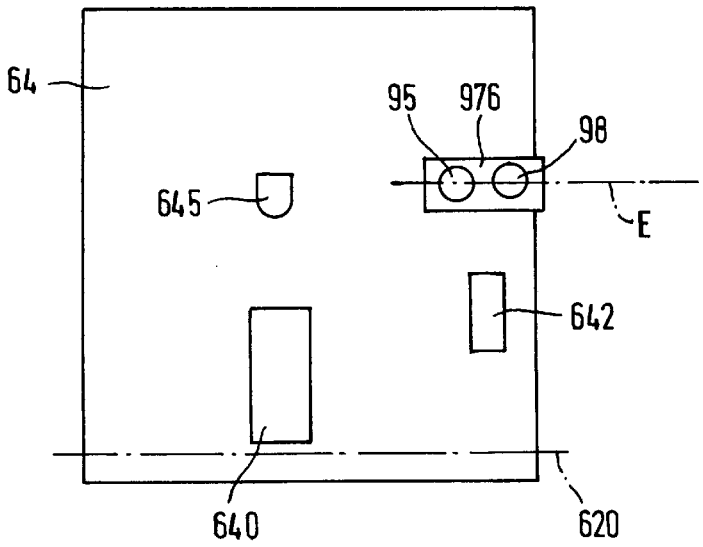
FIG. 5 shows a schematic front view of an embodiment of the invention, with two presentation ends to supply the open-end spinning device with compressed or suction air.

Four embodiments in which the open-end spinning device 6 is fed compressed air or in which a suction air stream is produced in the open-end spinning device 6 have been described above through FIGS. 1 through 3 or 4. It is of course also possible to combine the two controls. FIG. 5 shows a schematic front view of the cover 64 with a first opening 640 for the feeding of the fiber sliver 1 to the feeding device 2 (see FIG. 1) as well as with a second opening 645 through which the yarn removed from the spinning rotor 4 through the yarn draw-off pipe 5 leaves the open-end spinning device 6. In addition, the actuating lever 642 and the shaft 620 on which the cover 64 is mounted so as to be capable of a swiveling motion are indicated.

In front of the connection openings 83 (FIGS. 2 and 3) which are not shown and 830 (FIG. 4) are located the also not shown presentation ends 950 and 980 of the air channels 95 and 98 which are carried in the service carriage 9 by means of a joint holder 976. The presentation ends 950 and 980 are brought simultaneously and together into their presentation positions by a movement of this holder 976 or are removed from those positions.

It is of course also possible to present more than two presentation ends to corresponding connection openings, and these presentation ends can be subjected in different manners to either compressed or suction air.

To ensure that the same motion ratio results for the two presentation ends 950 and 980, as this normally facilitates their drive and their design, the two presentation ends 950 and 980 are placed by the suitably designed holder 976 on one and the same plane E which extends parallel to the axis 620 of the cover 64.

Instead of a intermediate segment 951 (FIGS. 1 to 3) 840 or 981 (FIG. 4) in the form of a hose, it is also possible to provide a suitable rod system. Furthermore, in particular for intermediate segment 840, a design in the form of a bellow is possible.

As a comparison between FIGS. 4 and FIGS. 2 and 3 shows, the valve 82 or 85 can be of different designs. It suffices to meet the requirement that it can be controlled directly or indirectly from the service carriage 9. Thus the valve 82 or 85, instead of being controlled pneumatically by means of the air stream controlled in the service carriage 9 by the control device 92, as shown in FIGS. 2 and 3, can also be controlled mechanically by the presentation movement of the presentation end 950 or 980. As closing element according to FIG. 4, instead of a ball 821 (see FIGS. 2 and 3), an axially moving valve cone 850 is provided in a suitable manner in a chamber 852, said cone being subjected to the force of a compression spring 851 which is supported—in a suitable manner in the chamber 852. The valve seat 853 against which the valve cone 850 bears in its closed position surrounds then the connection opening 830.

In the presentation end 980, a mechanical actuating element (pin 983) for the valve 85 is held in a suitable manner and extends beyond the outlet of the presentation end 980 in the axial direction and holds the valve cone 850 at a distance from its valve seat 852, thus holding the valve 85 open when the presentation end 980 is pressed against the valve seat 852.

The part of valve 85 which constitutes the valve seat 852 is part of a magnetic slaving unit in the embodiment shown. The other part of this magnetic slaving unit 66 is constituted by a solenoid 660 mounted on the presentation end 980 and connected for control via a control circuit 928 to the control device 92. In order to connect the presented presentation end 980 movably and interlockingly to the cover 64 so that it may follow it without changing its position relative thereto, the solenoid 660 is excited by the control device 92. If the presentation end 980 is to be removed again from the cover 64, the power supply to the solenoid 660 is interrupted so that it drops and the magnetic effect is ended.

The above-described embodiment examples show air conveying channels 8 or 84 which let out in the housing compartment 32 or 600. Similarly, it is of course possible to design an embodiment of the invention in which the air conveying channel lets out into the fiber feeding channel 30.

In another embodiment of the invention which is not shown here, the movable intermediate segment is not installed in the air channel 95, 98 which is located in the service carriage 9, but in the air conveying channel 8, 84. In this embodiment according to the invention a secure connection of air conveying channels 95, 98 and air conveying channels 8, 84 is ensured as the cover 64 is swiveled, if the valve 82, 85 allows for a corresponding movement relative to the cover 64.

It should be apparent to those skilled in the art that various modifications and variations can be made in the present device without departing from the scope and spirit of the invention. It is intended that the present invention cover such modifications and variations as come within the scope of the appended claims and their equivalents.

We claim:

1. An open-end spinning machine having a plurality of individual spinning stations wherein each said station comprises an opener roller disposed in a first housing compartment to open a fiber sliver into individual fibers, and a spinning rotor disposed in a second housing compartment with a fiber feeding channel connecting said housing compartments, said spinning rotor having a fiber collection surface to collect individual fibers conveyed from said opener roller, said open-end spinning machine further comprising:

at least one first air conveying channel at each said spinning station in pneumatic communication with at least one of said housing compartments and said fiber feeding channel, said air conveying channel comprising a connection opening;

a traveling service carriage disposed to travel alongside said spinning stations, said service carriage comprising at least one second air conveying channel having a presentation end configured for receipt within said connection opening;

a swiveling device installed on said service carriage and connected to a control device, said swiveling device operably disposed to swivel said connection opening during a service operation performed by said service carriage; and a flexible intermediate channel adjacent said presentation end so that said presentation end is movable with said connection opening as said connection opening is swivelled by said swiveling device.

2. The machine as in claim 1, wherein said second air channel is connectable to an overpressure source, and wherein said first air channel comprises an air channel directed upon a surface to be cleaned within said second housing compartment.

3. The machine as in claim 2, wherein said air channel is directed upon said fiber collection surface.

4. The machine as in claim 1, wherein said second air channel is connectable to a negative pressure source, and wherein said first air channel comprises an air channel directed upon a surface in said first housing compartment.

5. The machine as in claim 4, further comprising a second flexible intermediate segment disposed adjacent said connection opening in said first air channel.

6. The machine as in claim 1, further comprising a pivotal cover over components of said individual spinning stations, said connection opening disposed in said covering.

7. The machine as in claim 1, further comprising a plurality of said first air conveying channels each with a respective said connection opening, and wherein said service carriage comprises a plurality of second air conveying channels installed on a common holder device with respective said presentation ends, said presentation ends presented to said connection openings upon a single movement of said holder device.

8. The machine as in claim 1, wherein said connection opening comprises a centering segment widening in a direction towards said service carriage.

9. The machine as in claim 8, wherein said presentation end narrows in a direction towards said centering segment.

10. The machine as in claim 1, wherein said connection opening comprises a slaving device configured therewith, said slaving device maintaining said presentation end within said connection opening as said connection opening is swiveled by said swiveling device.

11. The machine as in claim 10, wherein said slaving device is magnetic.

12. The machine as in claim 11, wherein said magnetic slaving device comprises a solenoid disposed on said presentation end.

13. The machine as in claim 12, wherein said magnetic slaving device comprises a cylindrical receiving segment disposed in said connection opening, and said presentation end comprises a cylindrical longitudinal segment insertable into said cylindrical receiving segment.

14. The machine as in claim 13, wherein said connection opening further comprises a sealing ring in said receiving segment for sealing engagement with said cylindrical longitudinal segment.

15. The machine as in claim 1, wherein said flexible intermediate channel comprises a hose.

16. The machine as in claim 1, further comprising a pivotal cover over components of said individual spinning stations, said connection opening comprising an insert installed in a recess in said cover.

17. The machine as in claim 1, wherein said connection opening comprises a valve, and said presentation end comprises a mechanical actuating element for actuating said valve.

18. The device as in claim 1, further comprising a control device configured with said second air conveying channel to control movement thereof towards said connection opening during swiveling of said connection opening.

* * * * *